US006306356B1

(12) United States Patent
Woolery et al.

(10) Patent No.: US 6,306,356 B1
(45) Date of Patent: Oct. 23, 2001

(54) SEPARATION AND RECOVERY OF METAL VALUES FROM NATURAL BITUMEN ASH

(75) Inventors: Michael R. Woolery, Marlvern; Ledell Rigsby, Hot Springs, both of AR (US)

(73) Assignee: U.S. Vanadium Corporation

( * ) Notice: Subject to any disclaimer, the term of this patent is extended or adjusted under 35 U.S.C. 154(b) by 0 days.

(21) Appl. No.: 08/275,312

(22) Filed: Jul. 14, 1994

Related U.S. Application Data

(63) Continuation of application No. 08/031,814, filed on Mar. 15, 1993, now abandoned.

(51) Int. Cl.[7] ..... C22B 34/00; C22B 23/00; C22B 26/00

(52) U.S. Cl. ..... 423/65; 423/150.1; 423/155

(58) Field of Search ..... 423/67, 65, 62, 423/150.1, 155

(56) References Cited

U.S. PATENT DOCUMENTS

| | | | | |
|---|---|---|---|---|
| 1,621,038 | | 3/1927 | Thews | 423/65 |
| 3,190,720 | * | 6/1965 | Goren | 423/65 |
| 3,416,882 | | 12/1968 | Whigham | 23/15 |
| 4,100,251 | * | 7/1978 | Reinhardt et al. | 423/63 |
| 4,436,706 | | 3/1984 | Nacken et al. | 423/65 |
| 4,524,049 | * | 6/1985 | Sit | 423/65 |
| 4,539,186 | | 9/1985 | Schemel et al. | 423/62 |
| 4,637,920 | * | 1/1987 | Piuma | 423/63 |
| 4,788,044 | * | 11/1988 | Corigliano et al. | 423/62 |
| 4,849,189 | | 7/1989 | Jansz | 423/64 |
| 4,978,511 | | 12/1990 | Young | 423/65 |
| 5,122,353 | * | 6/1992 | Valentine | 423/244 |

FOREIGN PATENT DOCUMENTS

| | | |
|---|---|---|
| 2118022 | 10/1971 | (DE) . |
| 49-032404 | 8/1974 | (JP) . |

* cited by examiner

*Primary Examiner*—Steven Bos
(74) *Attorney, Agent, or Firm*—William C. Crutcher

(57) ABSTRACT

High yields of vanadium containing virtually no nickel or magnesium are obtained from natural bitumen ash consisting of up to 5% carbon, more than 95% of water-soluble compounds of vanadium, nickel and magnesium by mixing the ash with water to produce a 20% solids slurry of pH below 6.5 and temperature of 80–85° C. oxidizing any reduced vanadium in the slurry and then separating and removing the resulting polyvanadate precipitate from the liquid phase containing substantially all the nickel and magnesium values of the ash.

4 Claims, No Drawings

SEPARATION AND RECOVERY OF METAL VALUES FROM NATURAL BITUMEN ASH

This application is a continuation of application Ser. No. 08/031,814, filed Mar. 15, 1993, now abandoned.

FIELD OF THE INVENTION

This invention relates generally to the hydrometallurgical art, and is more particularly concerned with a novel method of separating vanadium values from natural bitumen ash in high yields and substantially free from nickel and magnesium values in the ash.

BACKGROUND OF THE INVENTION

As has been long known, vanadium-containing fuel oil ashes can be treated with mineral acid to dissolve the vanadium. Recovery is improved by adding a reducing agent to the leach solution prior to filtering to remove the ash residue from the acidic leach liquor. But this procedure is useful to advantage only if the vanadium recovery need not be so high that other metal values in the ash such as nickel and magnesium interfere with vanadium separation, making more complex and expensive vanadium separation steps necessary.

Another procedure for recovering vanadium from such ash containing 10 to 80% carbon involves selectively dissolving the vanadium in a caustic soda solution. An oxidizing agent is used in sufficient quantities to oxidize the vanadium as reduced vanadium is difficult to dissolve under alkaline conditions. The nickel and magnesium are left behind in the ash residue as vanadium is removed from the solution by solvent extraction, ion exchange or precipitation. But when the ash is that of natural bitumen and contains 10% or more of magnesium as the sulfate, for example, reagent consumption must be high in order to obtain soluble vanadium recoveries as high as 80–90%. Additionally, leaching at high base concentration is required for efficient reaction rate and further significantly increases the cost of the alkali leach process.

SUMMARY OF THE INVENTION

In accordance with this invention, based upon our discovery and novel concepts set out below, it is possible to recover vanadium in very high yields from natural bitumen ash in condition of purity amenable to furnacing or conventional vanadium recovery. Moreover, nickel and magnesium values can also be recovered in high yields and virtually free from vanadium and each other. Further, these new results can be obtained economically and without complex processing or high capital cost.

We have found that natural bitumen ash can be treated in such manner that essentially all its vanadium values are readily separated and removed from the nickel and magnesium values by dissolving them in water and then precipitating the vanadium as polyvanadate and filtering to separate the resulting solid and liquid phases.

This invention is also based upon our concept of slurrying the ash with water and establishing and maintaining the slurry pH below about 6.5 preferably about 2–3. At that stage, we oxidize the vanadium to pentavalant state preparatory to or coincident with heating the slurry to convert the vanadium to polyvanadate.

Filter cake consisting mainly of polyvanadate and containing virtually none of the nickel or magnesium content of the original ash, and the filtrate containing virtually none of the vanadium of the original ash, are further treated to produce the vanadium alloy or other vanadium product on the one hand, and to separate the nickel or magnesium values from each other and recover them in the form desired on the other hand.

In the broadest terms, the method of this invention comprises the steps of mixing natural bitumen ash with water to produce a slurry of 1–40% solids content, maintaining a 1–6.5 pH, agitating the slurry at 20–100° C. and precipitating the vanadium as polyvandate, and separating the solid phase from the liquid phase.

More specifically the new method of this invention embodying this discovery and these new concepts comprises the steps of adjusting the pH of the slurry to below about 6.5 then oxidizing the vanadium values to the pentavalent state, heating the acidified slurry and thereby precipitating the pentavalent vanadium values as polyvanadate and finally removing the solid phase containing substantially all of the vanadium values from the liquid phase containing substantially all the nickel and magnesium values of the ash.

DETAILED DESCRIPTION OF THE INVENTION

In the presently preferred practice of this invention natural bitumen ash is used as a source of recoverable vanadium values. This ash is produced from the burning of an emulsified bitumen marketed under the registered trade name Orimulsion. Orimulsion is produced in the Orinoco Belt in Venezuela by Petroleos de Venezuela S.A. and is offered world wide as a replacement for fuel oil and coal in electric power generating plants. It is produced by emulsifying the bitumen with water using a surfactant. A magnesium salt is also added to the emulsion which thus contains approximately 30% water.

In contrast to ashes resulting from burning fuel oils and coal, Orimulsion ash normally contains 1% of carbon or less and never more than 5% of carbon at most. Fuel oil ashes run 10 to 80% carbon and ashes from flexicoker units and ashes from burning petroleum cokes, while containing some of the same metals as Orimulsion ash, typically contain 75–80% carbon. Orimulsion ash is unique in that it contains 95% or more of the compounds of vanadium, nickel and magnesium. Most of these metal values are as metal sulfates and the ash is also unique in that it is up to 75% or more soluble in water. Fuel oil, petroleum coal and flexicoker ashes are typically insoluble or only slightly soluble (less than 5%) in water.

Depending upon how bitumen emulsion of the Orimulsion type is burned, the proportion of trivalent, tetravalent or pentavalent vanadium in the ash will vary according to the amount of oxygen available in the combustion atmosphere. Most of such ashes contain from 20 to 50% of vanadium in reduced form that is either trivalent or tetravalent state.

The orimulsion-type ash is first mixed with water to form a slurry of from 1 to 40% of slurry weight being the weight of the original ash added. A 20% solids slurry is preferred (i.e. the weight of the original ash is 20% of the total weight of the water and ash). Enough of an inorganic acid, preferably sulfuric acid, is added to the slurry to bring the pH below 6.5, preferably in the range of 2.0 to 3.0. In the usual case the ash will be acidic to the extent that no acid addition is required. If magnesium oxide or other alkali has been added to the ash, as previously mentioned, an acid addition may be necessary to bring the pH to the desired level.

An oxidizing agent is then added to the slurry, preferably in the form of sodium chlorate but suitably hydrogen peroxide, ozone, air, chlorine, potassium chlorate or sodium hypochlorite. In some instances, however, the vanadium is almost completely oxidized in the original ash and no oxidizing agent addition is required.

The slurry is agitated from 1–24 hours at 20–100° C. while the vanadium precipitates as oxidized polyvanadate, precipitating more rapidly at the upper end of the temperature range. A temperature of 80–85° C. is consequently preferred and under these circumstances 94–99+ % of vanadium precipitates, and also typically 95–99%+ of the nickel and magnesium contained in the ash is retained in solution in the leach liquor.

A novel feature of the process just described which distinguishes it from the typical acid leach is that vanadium is deliberately rendered insoluble.

When the precipitation is complete, the slurry is filtered and washed and solid filter cake contains precipitated vanadium as concentrated vanadium solid (typically 28–34% V). This product may be economically treated for vanadium recovery. The filtrate can be treated by conventional practice to separate the nickel values from the magnesium values, 95–100% of the nickel and magnesium present in the original ash being contained in the filtrate. The separation of nickel from magnesium for metals recovery can thus be done without interference from high levels of vanadium. For purposes of recovering the nickel, the ion exchange procedure commonly used in the prior art is suitable and the magnesium may be then recovered by precipitating the carbonate or hydroxide. The filter cake is suitably treated for recovery of the vanadium by an alkaline leach which involves very low reagent consumption, or it can be dried and furnaced to produce vanadium alloy in accordance with known practice.

Those skilled in the art will gain a further and better understanding of the present invention from the following illustrative, but not limiting, examples of the actual practice of this invention.

EXAMPLE I

Orimulsion Ash Containing High Levels of Oxidized Vanadium

A sample of naturally acidic Orimulsion ash containing oxidized vanadium (#OR-A-P) analyzed 7.20% V; 1.48% Ni; and 11.24% Mg.

100 grams of the sample was mixed with 1088 grams of water and agitated at 40 degrees C. for 16 hours (8.42% solids). No oxidant was added. The slurry pH was 2.9 and no acid was added. The mixture was then filtered and the components analyzed. 73.7% of the ash was found to have been dissolved. The filter cake contained 95.22% of the vanadium from the ash while 93.1% of the magnesium and 82.6% of the nickel had solublized into the filtrate. The filter cake which contained 27.30% vanadium on a dry basis was subsequently alkaline leached with NaOH. The resultant leach liquor contained 93.1% of the vanadium in the filter cake and essentially no magnesium or nickel. In this case the ash treatment process allowed economical and conventional recovery of the contained vanadium from the ash while quantitatively removing the other metals from the solubilized vanadium.

EXAMPLE II

Orimulsion Ash Containing Reduced Vanadium and the Effect of Temperature

The tests in this example were done on a different sample of Orimulsion ash from the same source (#D-1-B). This ash contained 7.76% V; 1.92% Ni; and 13.58% Mg and was also naturally acidic.

Enough water was added to 100 grams of the above ash to produce a 10.0% solids slurry. The mixture had a 3.7 pH and thus no acid was added. The slurry was agitated for 14.5 hours at room temperature (20 deg. C.). No oxidant was added. The slurry was then filtered and the components analyzed. 78.8% of the ash dissolved leaving 81.4% of the vanadium as insoluble in the filter cake which contained 27.73% vanadium on a dry basis. 93.9% of the magnesium and 80.9% of the nickel contained in the original ash were solublized. Thus a significant portion of the ash vanadium was solubilized (18.6%) and lost to further recovery.

The same sample was tested as above except at 17.6% solids and the slurry temperature maintained at 65 degrees C. Vanadium recovery in the filter cake was 80.6% and 19.4% of the vanadium was lost to the filtrate. 93.7% of the magnesium and 88.0% of the nickel were also solubilized. The dry filter cake contained 24.71% vanadium.

The same sample was tested as above except that the slurry temperature was maintained at 84 degrees C. This time vanadium recovery in the filter cake increased to 93.2% with 6.8% of the vanadium solubilized in the filtrate as were 94.5% of the magnesium and 84.6% of the nickel. The dry filter cake contained 29.87% vanadium.

EXAMPLE III

Effect of Oxidant Addition on Vanadium Precipitation

The tests in this section were done on yet a different Orimulsion ash sample (#B-2-2) from the same source. The sample analyzed 6.69% V; 1.50% Ni; and 12.01% Mg. This sample was naturally acidic.

Enough water was added to 100 grams of the Orimulsion ash sample to form a slurry of 30% solids which was agitated 16 hours at a temperature of 85 degrees C. The slurry pH was 2.7 and no acid or other reagents were added. The slurry was then filtered and the components analyzed. 75.4% of the ash dissolved in the filtrate which contained 99.4% of the ash magnesium and 97.4% of the ash nickel. Only 5.1% of the contained vanadium was solubilized and 94.9% of the vandium reported to the filter cake which contained 35.31% vanadium on a dry basis.

The above test was repeated with the addition of 1.5 grams of sodium chlorate to the slurry. The slurry pH was 2.1. At the end of the 16 hours the slurry was filtered and the components analyzed. The soluble vanadium lost to the filtrate decreased to 0.8% of the vanadium contained in the ash (99.2% of the vanadium reported to the filter cake). 96.9% of the nickel was solublized.

These tests demonstrated that addition of an oxidizing agent increases vanadium precipitation efficiency at acidic pH and 85 degrees C.

EXAMPLE IV

Orimulsion Ash Containing Added Magnesium Oxide

Test work in this example was done on two samples of Orimulsion ash from a European power plant (#P-J-1 & #P-J-2). The plant added magnesium oxide to the ash as it was formed to neutralize the acidic nature of the ash. Therefore this ash contained higher magnesium values and lower vanadium and nickel contents than the Orimulsion ashes used in the testwork discussed in the previous three sections. This ash is basic in nature.

Sample #P-J-1 contained 5.11% vanadium, 16.1% magnesium and 1.06% nickel.

Sample #P-J-2 contained 5.18% vanadium, 17.8% magnesium and 1.18% nickel.

Enough water was added to 100 grams of the sample #P-J-2 ash to produce a slurry of 20% solids which was then agitated for 6 hours at a temperature of 85 degrees C. No reagents were added. The pH of the slurry was 8.1. The slurry was then filtered and the components analyzed. 22.0% of the vanadium dissolved into the filtrate but only 60.6% of the magnesium and 0.04% of the nickel dissolved. The filter cake contained only 10.55% vanadium on a dry basis. 69.3% of the ash was solubilized.

The above test was repeated with sample #P-J-1 ash. the results were similar to the first test. The slurry pH was also 8.1 and 71% of the ash dissolved. 22.2% of the vanadium, 61.4% of the magnesium and 0.9% of the nickel were found in the filtrate. The filter cake contained 77.8% of the vanadium in the ash as a 10.55% vanadium solid.

The above test was repeated on sample #P-J-1 with the addition of 39 grams of sulfuric acid and the slurry (18.5% solids) agitated for 16 hours at 85 degrees C. The slurry pH was 2.7. the slurry was then filtered and the components analyzed. 87.7% of the ash had dissolved. 38.5% of the vanadium was found dissolved in the filtrate along with 98.0% of the magnesium and 81.2% of the nickel in the ash. The filter cake contained 61.5% of the vanadium as a 27.5% vanadium solid (dry basis).

Another similar test was done using sample #P-J-2 and adding an oxidant to the slurry. Enough water was added to the ash to produce a slurry of 19.9% solids. 39 grams of sulfuric acid and 1.5 grams of sodium chlorate were added and the slurry agitated for 16 hours at 85 degrees C. The slurry was then filtered and the components analyzed. 81.7% of the ash had dissolved. Loss of the vanadium to the filtrate had decreased to 6.6% whereas 98% of the magnesium and 94.3% of the nickel were solublized. The dry filter cake contained 93.4% of the ash vanadium as a 28.2% vanadium solid.

These tests establish that a high magnesium, alkaline Orimulsion ash can be treated by addition of both acid and oxidizing agent to recover 94% or better of the vanadium enriched solid from a water solution leaving 94–99% of the magnesium and nickel solublized in the water.

In this specification and in the appended claims, wherever percentages, proportions, ratios or amounts are stated, reference is to the weight basis unless otherwise expressly stated.

What is claimed is:

1. A method of recovering vanadium values from natural bitumen ash containing vanadium, nickel and magnesium values which comprises the steps of slurrying the ash with water, then adding oxidizing agent and sulfuric acid to maintain the resulting slurry at a pH of between 2 and 3, thereafter agitating said slurry for 1–24 hours at temperatures between 20° C. and 100° C., and then separating and removing the solid phase of undissolved ash and insoluble vanadium values from the liquid phase containing essentially all the nickel and magnesium values in solution.

2. The method of claim 1 in which sodium chlorate is the oxidizing agent and in which the vanadium values dissolved in the slurry are oxidized and precipitated and are removed from the slurry along with undissolved ash and insoluble vanadium.

3. The method of claim 1 in which the slurry temperature is maintained at 80–85° C. as the slurry is agitated.

4. The method of claim 1 in which slurry agitation is continued for about 16 hours and about 98% of the magnesium is solubilized, and in which about 94% of the nickel is solubilized, and in which about 93% of the vanadium is contained in the filter cake obtained by filtering the slurry following the agitation step.

* * * * *